US011530671B2

(12) United States Patent
Talaski et al.

(10) Patent No.: US 11,530,671 B2
(45) Date of Patent: Dec. 20, 2022

(54) MULTIPLE PUMP FUEL SYSTEM

(71) Applicant: Walbro LLC, Tucson, AZ (US)

(72) Inventors: Edward J. Talaski, Caro, MI (US); Elton J. Fisch, Caro, MI (US)

(73) Assignee: Walbro LLC, Cass City, MI (US)

( * ) Notice: Subject to any disclaimer, the term of this patent is extended or adjusted under 35 U.S.C. 154(b) by 0 days.

(21) Appl. No.: 17/299,197

(22) PCT Filed: Dec. 17, 2019

(86) PCT No.: PCT/US2019/066784
§ 371 (c)(1),
(2) Date: Jun. 2, 2021

(87) PCT Pub. No.: WO2020/131835
PCT Pub. Date: Jun. 25, 2020

(65) Prior Publication Data

US 2022/0074377 A1 Mar. 10, 2022

Related U.S. Application Data

(60) Provisional application No. 62/782,770, filed on Dec. 20, 2018.

(51) Int. Cl.
*F02M 37/10* (2006.01)
*F02M 37/18* (2006.01)

(52) U.S. Cl.
CPC ..... *F02M 37/10* (2013.01); *F02M 37/18* (2013.01)

(58) Field of Classification Search
CPC ..... F02M 37/10; F02M 37/18
See application file for complete search history.

(56) References Cited

U.S. PATENT DOCUMENTS 4,683,864 A 8/1987 Bucci
5,655,504 A * 8/1997 Iwai ..... F02M 37/10 123/511

(Continued)

FOREIGN PATENT DOCUMENTS

JP 2009235960 A 10/2009
JP 2009243336 A * 10/2009

(Continued)

OTHER PUBLICATIONS

Written Opinion & International Search Report for PCT/US2019/066784 dated Apr. 17, 2020, 12 pages.

*Primary Examiner* — Jacob M Amick
*Assistant Examiner* — Charles J Brauch
(74) *Attorney, Agent, or Firm* — Reising Ethington P.C.; Matthew J. Schmidt

(57) ABSTRACT

In at least some implementations, a fuel pump assembly includes a first fuel pump and a second fuel pump that each have an electric motor, a pumping element driven by the motor, an inlet and an outlet through which fuel is discharged. The assembly also includes a passage communicated with the outlet of the first fuel pump and with the outlet of the second fuel pump, a fuel outlet in communication with the passage and through which fuel exits the fuel pump assembly, and a valve having an inlet in communication with the passage between the outlet of the first fuel pump and the outlet of the second fuel pump. The valve also having an outlet through which fuel exits the passage and a valve body that controls fuel flow through the valve.

15 Claims, 2 Drawing Sheets

(56) References Cited

U.S. PATENT DOCUMENTS

| | | | | |
|---|---|---|---|---|
| 6,283,142 | B1 * | 9/2001 | Wheeler | F02M 37/0094 123/509 |
| 2008/0230035 | A1 * | 9/2008 | Inoue | F02D 33/003 123/497 |

FOREIGN PATENT DOCUMENTS

| | | | | |
|---|---|---|---|---|
| JP | 2009243446 | A | 10/2009 | |
| WO | WO-2018045311 | A2 * | 3/2018 | F02M 37/10 |
| WO | WO2018045311 | A2 | 3/2018 | |

* cited by examiner

MULTIPLE PUMP FUEL SYSTEM

REFERENCE TO RELATED APPLICATIONS

This application claims the benefit of U.S. Provisional Application Ser. No. 62/782,770 filed on Dec. 20, 2018 the entire contents of which are incorporated herein by reference in its entirety.

TECHNICAL FIELD

The present disclosure relates generally to a fuel system that has more than one fuel pump.

BACKGROUND

Some fuel systems include more than one fuel pump from which fuel is delivered to support operation of an engine. The fuel pumps may be driven at full speed and excess fuel may be diverted by a pressure regulator which may be located within a fuel tank or downstream of the fuel tank with diverted fuel returned to the fuel tank through a conduit. Running two fuel pumps at full speed increases the electrical draw of the fuel system and the cost to run the fuel system. Further, some systems are arranged so that failure of one fuel pump renders the system inoperable to supply fuel to the engine to support operation of the engine, even in a limited capacity. Improved control of the fuel pumps, the flow rate of fuel delivered from the fuel pumps, vapor handling and other features or improvements are desired separately or in combination.

SUMMARY

In at least some implementations, a fuel pump assembly includes a first fuel pump and a second fuel pump. The first fuel pump has an electric motor, a pumping element that is driven by the motor, an inlet through which fuel enters the first fuel pump and an outlet through which fuel is discharged from the first fuel pump. The second fuel pump has an electric motor, a pumping element that is driven by the motor, an inlet through which fuel enters the second fuel pump and an outlet through which fuel is discharged from the second fuel pump. The assembly also includes a passage communicated with the outlet of the first fuel pump and with the outlet of the second fuel pump, a fuel outlet in communication with the passage and through which fuel exits the fuel pump assembly, and a valve having an inlet in communication with the passage between the outlet of the first fuel pump and the outlet of the second fuel pump. The valve also having an outlet through which fuel exits the passage and a valve body that controls fuel flow through the valve.

In at least some implementations, the valve is electrically operated to control movement of the valve body between open and closed positions. In at least some implementations, at least one of the first fuel pump motor and the second fuel pump motor is driven by a pulse width modulated signal. In at least some implementations, during at least some operating conditions, fuel from both the first fuel pump outlet and the second fuel pump outlet is discharged from the assembly through the fuel outlet.

In at least some implementations, the assembly also includes a pressure regulator having an inlet in communication with the passage between the valve and the second fuel pump outlet, an outlet from which fuel exits the passage and a valve body between the inlet and the outlet. The valve body is responsive to a pressure of fuel at the pressure regulator inlet that is above a threshold pressure to permit fuel to flow through the pressure regulator outlet. In at least some implementations, a reservoir is provided that has an interior and a divider in the interior, and the interior includes a first portion on one side of the divider that is in communication with the first fuel pump inlet and a second portion on the other side of the divider that is in communication with the second fuel pump inlet. The outlet of the valve may be in communication with the second portion of the interior. In at least some implementations, a first check valve carried by the divider that permits fuel flow from the second portion to the first portion. In at least some implementations, a second check valve carried by the divider that permits fuel flow from the first portion to the second portion. In at least some implementations, a first check valve carried by the divider that permits fuel flow from the second portion to the first portion, and which includes a second check valve carried by the divider that permits fuel flow from the first portion to the second portion.

In at least some implementations, a pressure regulator has an inlet in communication with the passage between the valve and the second fuel pump outlet, an outlet from which fuel exits the passage and a valve body between the inlet and the outlet. The valve body may be responsive to a pressure of fuel at the pressure regulator inlet that is above a threshold pressure to permit fuel to flow through the pressure regulator outlet, and the pressure regulator outlet is in communication with the second portion of the interior.

In at least some implementations, a fuel pump assembly, includes a first fuel pump having an electric motor, a pumping element that is driven by the motor, an inlet through which fuel enters the first fuel pump, a first outlet through which fuel is discharged from the first fuel pump and a second outlet through which fuel is discharged from the first fuel pump. A second fuel pump has an electric motor, a pumping element that is driven by the motor, an inlet through which fuel enters the second fuel pump and an outlet through which fuel is discharged from the second fuel pump. A passage is communicated with the first outlet of the first fuel pump and with the outlet of the second fuel pump, a fuel outlet is in communication with the passage and through which fuel exits the fuel pump assembly, and a valve has an inlet in communication with the second outlet of the first fuel pump, an outlet through which fuel exits the valve, and a valve body that controls fuel flow through the valve. The valve body is closed to inhibit or prevent fuel flow through the valve, more fuel exits the first fuel pump through the first outlet.

In at least some implementations, the assembly includes a reservoir that has an interior and a divider in the interior, and the interior includes a first portion on one side of the divider that is in communication with the first fuel pump inlet and a second portion on the other side of the divider that is in communication with the second fuel pump inlet. In at least some implementations, the passage has a second end through which fuel exits the passage and the second end is communicated with the second portion of the interior.

In at least some implementations, the assembly includes a passage communicated at one end with the valve to receive fuel that flows through the valve, and a jet or restricted orifice located in the passage downstream of said one end, and the jet or restricted orifice has a smaller flow area than the adjacent portions of the passage and the jet or restricted orifice controls the flow rate of fuel in the passage.

In at least some implementations, the assembly includes a pressure regulator having an inlet in communication with the passage, an outlet from which fuel exits the passage and a valve body between the inlet and the outlet. The valve body may be responsive to a pressure of fuel at the pressure regulator inlet that is above a threshold pressure to permit fuel to flow through the pressure regulator outlet, and the pressure regulator outlet may be in communication with the second fuel pump inlet.

In at least some implementations, the assembly includes a reservoir having an interior and a divider in the interior, and the interior includes a first portion on one side of the divider that is in communication with the first fuel pump inlet and a second portion on the other side of the divider that is in communication with the second fuel pump inlet, and the interior is sealed and capable of containing fluid at above atmospheric pressure. The assembly may also include a fuel pressure regulator that has an inlet communicating with the second portion of the reservoir interior, an outlet communicating with the first portion of the reservoir interior, and a valve body between the fuel pressure regulator inlet and the fuel pressure regulator outlet that is normally closed to prevent fuel flow through the fuel pressure regulator until the pressure at the fuel pressure regulator inlet is above a threshold pressure wherein the valve body moves to an open position and fuel from the second portion of the reservoir interior flows into the first portion of the reservoir interior. In at least some implementations, the assembly also includes a second fuel pressure regulator having an inlet in communication with the passage, an outlet from which fuel exits the passage and a valve body between the second fuel pressure regulator inlet and the second fuel pressure regulator outlet. The second fuel pressure regulator valve body being responsive to a pressure of fuel at the second fuel pressure regulator inlet that is above a threshold pressure to permit fuel to flow through the second fuel pressure regulator outlet, and wherein the second fuel pressure regulator outlet is in communication with the second fuel pump inlet.

In at least some implementations, a passage is communicated at one end with the valve to receive fuel that flows through the valve, and a jet or restricted orifice located in the passage downstream of said one end, wherein the jet or restricted orifice has a smaller flow area than the adjacent portions of the passage and the jet or restricted orifice controls the flow rate of fuel in the passage, and wherein the passage includes an inlet arranged so that fluid flow through the jet or restricted orifice draws fluid through the inlet and into the passage.

BRIEF DESCRIPTION OF THE DRAWINGS

The following detailed description of certain embodiments and best mode will be set forth with reference to the accompanying drawings, in which.

DETAILED DESCRIPTION

Figure 1:
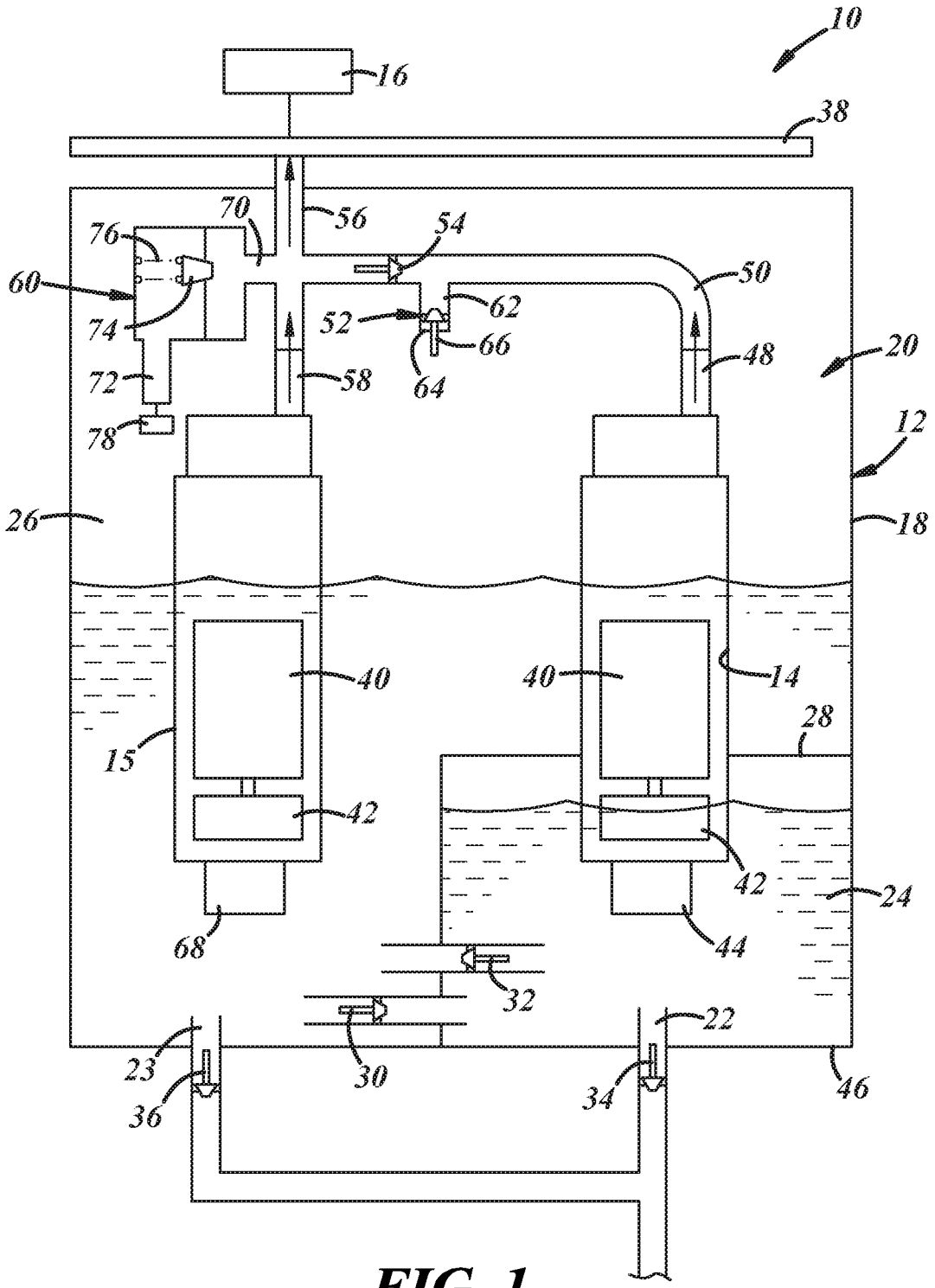
FIG. 1 is a schematic view of a fuel pump assembly including two fuel pumps received within a container in which a supply of fuel is maintained.

Referring in more detail to the drawings, FIG. 1 illustrates a fuel pump assembly 10 having a container or reservoir 12 in which a supply of fuel is contained, and multiple fuel pumps, shown as a first fuel pump 14 and a second fuel pump 15, arranged to pump fuel from the reservoir 12 for use by an engine 16. During times of high engine fuel demand, each fuel pump (i.e. both pumps 14 and 15 in the illustrated example) may provide fuel to the engine together, and during times of lesser engine fuel demand, fewer than all pumps (i.e. only one pump 15 in the illustrated example) provides fuel to the engine. In this way, the maximum flow rate of fuel from the fuel pump assembly 10 to the engine 16 may be greater than the maximum output flow rate from any one fuel pump 14 or 15, but such maximum flow rate of fuel to the engine may be selectively provided from the fuel pumps 14, 15 when demanded by the engine rather than continuously. Various valves and/or other flow controllers may be used to control the routing of fuel in and from the fuel assembly, as set forth in more detail below.

The reservoir 12 may include or be defined at least in part by a main body 18 that defines at least part of an internal volume or interior 20 in which liquid fuel is retained. A first inlet 22 of the reservoir 12 may be communicated with a first portion 24 of the interior 20, and a second inlet 23 of the reservoir may be communicated with a second portion 26 of the interior 20. The first and second portions 24, 26 of the reservoir interior 20 may be separated from each other by a wall 28 or other divider (with the first portion 24 on one side of the divider and the second portion 26 on the other side of the divider), and may communicate with each other through one or more valves provided in the wall 28 or divider, to ensure at least some fuel is present in each portion 24, 26 so long as there is fuel in either portion at or above the height/level of one of the valves (or the only valve when only one valve is provided). In at least some implementations, two oppositely acting check valves 30, 32 are provided with one valve 30 permitting fuel flow from the first portion 24 to the second portion 26 and the other valve 32 permitting fuel flow from the second portion 26 to the first portion 24. Inlet check valves 34 and 36 may be provided in the first and second inlets 22, 23, respectively, to prevent flow of fuel out of the reservoir through the first and second inlets. With the valve 30 permitting flow from the first portion 24 to the second portion 26, the second inlet check valve 36 and second inlet 23 may be omitted, as the second pump 15 may draw fuel into the reservoir interior 20 through the first inlet 22 and the valve 30. In at least some implementations, the reservoir main body 18 may be supported by a mounting flange 38 that is sealed to a fuel tank, to support the fuel pump assembly 10 within the fuel tank. Of course, other arrangements may be used, including arrangements in which the fuel pump assembly 10 is mounted outside of the fuel tank (e.g. not within an interior of the fuel tank) in which case the reservoir 12 may include a lid or second body coupled to the main body 12 to enclose the interior 20.

The first and second fuel pumps 14 and 15 may each include an electric motor 40 and a pumping element 42 driven by the motor 40. The pumping elements 42 may be a of a positive displacement type, like a gerotor or screw pump, or a centripetal pump like a turbine type pump with an impeller, as is known in the art. The fuel pumps 14 and 15 may be identical in construction (i.e. size, motor, output capability, etc) or they may be different, as desired for a particular application.

The first fuel pump 14 may be arranged to move fuel from a fuel supply (e.g. an interior of a fuel tank) into the reservoir interior 20 through the first inlet 22 of the reservoir, and to move fuel from the first portion 24 to the second portion 26 and/or to the engine 16. To draw fuel into the first portion 24 and to take fuel from the first portion 24 into the fuel pump 14, the fuel pump 14 has an inlet 44 communicated with the pumping element 42 and in or at which a subatmospheric or decreased pressure is caused by rotation of the pumping element 42. A low pressure fuel pump could instead be used to move fuel from the fuel tank to the first portion 24 of the reservoir 12 communicated with the fuel pump inlet. That is, in at least some implementations, a third pump may be used to deliver fuel to the fuel pump assembly 10, if desired. The first pump inlet 44 may be arranged in the first portion 24 so that it is relatively close to a bottom wall 46 of the reservoir 12, for example, within one-half of an inch to facilitate drawing in fuel even when relatively little fuel is within the first portion 24. In this position, the first pump inlet 44 may be submerged in liquid fuel during normal operation of the assembly 10, which may include all or nearly all instances except where the fuel supply is low on fuel and when the reservoir 12 has a low level of or no fuel therein. This may maintain a head of liquid at the first pump inlet 44, and the first pump inlet 44 wetted to improve the performance and efficiency of the first pump 14. The first fuel pump 14 has an outlet 48 through which fuel is discharged from the pump 14 and from the first portion 24 of the interior 20. The first pump outlet 48 is communicated with a passage 50 that routes the fuel away from the first pump 14.

The passage 50 may be defined by one or more conduits or bodies that may carry one or more components that control fuel flow through the passage. In the example shown, the passage 50 includes or communicates with, to direct fuel flow to, one or more of a flow control valve 52, a check valve 54, a fuel assembly outlet 56 through which fuel is discharged from the fuel assembly 10 (e.g. to the engine 16), an outlet 58 of the second pump 15, and a fuel pressure regulator 60. The flow control valve 52 has an inlet 62 in communication with the passage 50, an outlet 64 in communication with the second portion 26 of the reservoir 20 and a valve body 66 that controls flow through the valve 52. The valve body 66 is movable between first and second positions. When the valve body 66 is in a first position, the valve body 66 permits fuel flow through the valve outlet 64 to direct fuel discharged from the first pump 14 into the second portion 26 of the reservoir interior 20. When the valve body 66 is in a second position, the valve element prevents fuel flow through the valve outlet 64 and fuel discharged from the first fuel pump 14 flows past the flow control valve 52 and through the check valve 54. The check valve 54 may be arranged to permit fluid flow from the first fuel pump 14 to the fuel assembly outlet 56, but to prevent the reverse flow through the passage 50 so that fuel downstream of the check valve 54 is not drained through the fuel control valve 52 or first fuel pump 14.

The second fuel pump 15 may be arranged to do one or both of move fuel from a fuel supply into the second portion 26 of the reservoir interior 20 through the second inlet 23, and move fuel from the second portion 26 of the reservoir interior 20 to the fuel pump assembly outlet 56 for delivery to the engine 16. To draw fuel into the second portion 26 and to take fuel from the second portion 26 into the second fuel pump 15, the second fuel pump 15 has an inlet 68 communicated with the pumping element 42 and in or at which a subatmospheric or decreased pressure is caused by rotation of the pumping element 42. The second pump inlet 68 may be arranged in the second portion 26 so that it is relatively close to the bottom wall 46 of the reservoir 12, for example, within one-half of an inch to facilitate drawing in fuel even when relatively little fuel is within the second portion 26. In this position, the second pump inlet 68 may be submerged in liquid fuel during normal operation of the assembly 10, which may include all or nearly all instances except where the fuel supply is low on fuel and when the reservoir 12 has a low level of or no fuel therein. This may maintain a head of liquid at the second pump inlet 68, and the second pump inlet 68 wetted to improve the performance and efficiency of the second pump 15. Fuel is discharged from the second pump 15 and from the second portion 26 of the reservoir interior 20 through the second pump outlet 58.

The second pump outlet 58 is communicated with the passage 50 and the fuel pump assembly outlet 56. In at least some implementations, the check valve 54 and the fuel control valve 52 are between the outlets 48, 58 of the first and second pumps 14, 15, and relative to the second pump 15, the flow control valve 52 is downstream of the check valve 54 such that the check valve 54 prevents fuel discharged from the second pump 15 from flowing to the flow control valve 52. The fuel discharged from the second pump 15 may be communicated with the pressure regulator 60. The pressure regulator 60 may include an inlet 70, an outlet 72 and a valve body 74 between the inlet 70 and outlet 72. When the fuel pressure at the valve inlet is below a threshold (which may be defined at least in part by a spring 76 that biases the valve body 74), the valve body 74 prevents fuel flow through the valve outlet 72 and the fuel flows through the fuel pump assembly main outlet 56 for delivery to the engine 16. When the fuel pressure at the valve inlet 70 is above the threshold pressure, the valve body 74 is moved to an open position to permit some fuel flow out of the valve outlet 72 and into the second portion 26 of the reservoir interior 20 (and/or first portion 24, if desired). This reduces the pressure of the fuel so that the pressure of fuel delivered to the engine 16 may be regulated, in known manner. Fuel discharged from the first pump 14 that does not flow through the fuel control valve 52 to the second portion 26 of the reservoir interior 20, is combined with fuel discharged from the second pump 15, and the pressure of the combined fuel flows is regulated in the same manner and the combined fuel flow is discharged from the fuel pump assembly 10 through the main outlet 56, in at least some operating conditions.

Thus, both fuel pumps 14 and 15 may draw fuel into the reservoir interior 20 and both fuel pumps 14, 15 may discharge fuel from the reservoir interior 20 for delivery to the engine 16. In this way, the amount that may be taken into the reservoir interior 20 to support pumping fuel to the engine 16 is not limited by the intake capacity of just one pump 14 or 15, as both pumps 14 and 15 draw fuel into the reservoir 12. Similarly, the flow rate of fuel delivered from the fuel pump assembly 10 is not limited to the output flow rate of just one pump 14 or 15 as both pumps 14 and 15 may simultaneously provide fuel to the engine 16. In this way, the maximum fuel flow rate from the assembly 10 may be greater than the flow rate possible from either fuel pump 14 or 15 by itself. In at least some implementations, when the engine fuel demand is less than or equal to the maximum fuel output of the second pump 15, the output from the first pump 14 may be directed into the second portion 26 of the reservoir interior 20 to provide fuel for the second pump 15, in addition to that fuel which the second pump 15 draws into the reservoir interior 20 through the second inlet 23. When the engine fuel demand exceeds the maximum fuel output of the second pump 15, the fuel control valve 52 may reduce the flow rate of or prevent fuel flow through the valve outlet 64 so that at least a portion and up to all of the fuel discharged from the first pump 14 is combined with the fuel discharged from the second pump 15 for delivery to the engine 16. Of course, at least some output from the first pump 14 can be used to supplement the fuel provided from the second pump 15 even when the engine fuel demand is below the maximum fuel output of the second pump 15, as desired. In at least some implementations, some of the fuel from both pumps 14 and 15 may be used to satisfy the engine's fuel demand over a wide range of fuel flow rates up to and including all fuel flow rate demands of the engine 16.

In at least some implementations, when the engine fuel demand can be met by either pump, the other pump may be shut off or not powered. That is, the engine fuel demand up to a threshold could be met by only the first fuel pump 14, or by only the second fuel pump 15, in at least some implementations.

The motor 40 of either or both of the first and second pumps 14, 15 can be operated by a pulse width modulated signal to vary the electrical power provided to the pump motor 40 and thereby vary the pump output to support the engine fuel demand. The fuel control valve 52 can be responsive to a fuel output flow rate, for example with a flow rate sensor providing a signal used to close the fuel control valve 52 which may be, for example, an electro-mechanical valve such as a solenoid valve. For example, when the output of the first fuel pump 14 is above a threshold level, for example but not limited to 100 liters per hour, the fuel control valve 52 may be closed to route the output of the first fuel pump 14 to the engine 16 (subject to some fuel being bypassed by the pressure regulator 60, if provided). At lower flow rates, the fuel control valve 52 may be opened and all or at least some of the fuel discharged from the first pump 14 may be routed through the control valve 52 to the second portion 26 of the reservoir interior 20. If the output of the first pump 14 is constant, then the fuel control valve 52 can be opened and closed based upon the engine fuel demand and the flow rate of fuel needed to support engine operation in combination with the fuel discharged from the second fuel pump 15.

The engine fuel demand can be determined in different ways. For example, the flow rate of fuel discharged from the regulator outlet 72 may be monitored and used to determine the engine fuel demand as a function of the output of the second pump 15 and/or first pump 14. This information may be used to determine the power provided to either or both pumps 14, 15 (e.g. via PWM drive) and/or to control opening and closing of the fuel control valve 52. A flow switch 78 could be used that, when there is fuel flow out of the pressure regulator outlet 72, provides a signal to control the fuel control valve 52 and/or provides a signal that one or the other of the fuel pumps 14, 15 can be shut off until such time as the engine demands a greater fuel flow rate. Alternatively, when there is no fuel flow from the regulator outlet 72, or if the flow out of the regulator outlet 72 is below a threshold, the flow switch 78 may provide a signal to indicate that the fuel flow from one or both fuel pumps 14, 15 should be increased, and/or to close the fuel control valve 52 to increase fuel flow from the first pump 14 that reaches the regulator 60 and main outlet 56 of the fuel pump assembly 10. As an alternative, a valving arrangement such as is shown in U.S. Pat. No. 4,683,864 may be used to mechanically open or close the flow control valve as a function of the flow through the flow control valve.

The fuel control valve 52 may be biased or normally in an open position. In this position, fuel vapors and air in the reservoir interior 20 may be allowed to flow into and through the fuel control valve outlet 64, and such gasses may flow out of the fuel pump 14 through the outlet 48 when the valve 64 is opened, either by fuel flow or by pressure within the pump 14. Further, the first pump outlet 48 could be separately routed from the fuel pump assembly 10, such as through a second outlet of the assembly that is separate from the main outlet 56 already described. That is, the first fuel pump 14 may be communicated with the flow control valve 52 and output from the first fuel pump 14 may flow through the control valve 52 and/or through a second output of the assembly 10 separate from any output from the second pump 15. A second pressure regulator may be used, if desired, in the pump assembly 10 or a pressure regulator may be provided downstream of the assembly 10 with a return line used to return fuel to the reservoir that was discharged from the assembly 10 in excess of engine fuel demand. Thus, the fuel pumps 14, 15 may be arranged in a parallel relationship, and may separately draw fuel into the reservoir interior 20 and separately discharged fuel to the engine 16. The output of the pumps 14, 15 may be combined a in single flow path that exits a single outlet 56 of the assembly 10, or the output of the pumps 14, 15 may be discharged through separate outlets of the assembly.

Figure 2:
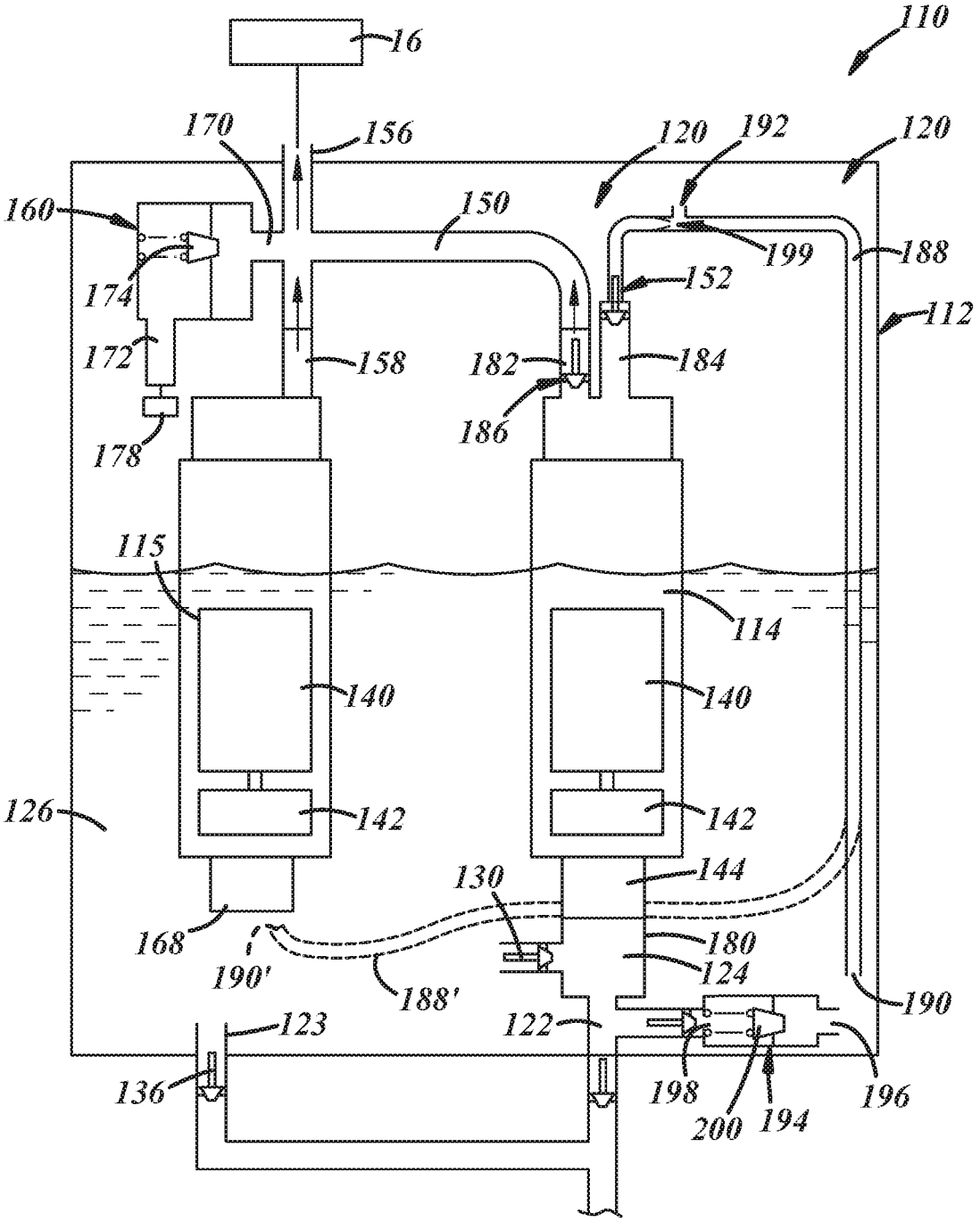
FIG. 2 is a schematic view of another fuel pump assembly.

The fuel pump assembly 110 shown in FIG. 2 has many similar features and components as in the fuel pump assembly 10 shown in FIG. 1. To facilitate the description of the fuel pump assembly 110, components will be given the reference numerals offset by one hundred from the reference numerals given to similar components in the fuel pump assembly 10, and the following description will focus on the differences between the two assemblies 10 and 110.

The fuel pump assembly 110 also includes a first pump 114 and a second pump 115 that are received in an interior 120 of a reservoir 112, to pump fuel into the reservoir 112 and out of the reservoir 112 for delivery to an engine. The second fuel pump 115 has an inlet 168 that draws in fuel and an outlet 158 through which fuel is discharged. The outlet 158 of the second fuel pump 115 may be communicated with a fuel pressure regulator 160 arranged as set forth with regard to the fuel pump assembly 10, and communicated with or routed to the main outlet 156 of the fuel pump assembly 110 for delivery to the engine 16. The second fuel pump 115 may operate as set forth with regard to the second pump 15 in the fuel pump assembly 10, including drawing fuel into the reservoir interior 120 via a second inlet 123 and associated check valve 136, or an optional check valve 130 carried by an inlet body 180 of the first fuel pump 114 to draw fuel in through the first inlet 122, the first portion 124 and the optional check valve 130 (in the latter instance, no second inlet 123 is needed). The inlet body 180 defines the divider in the interior 120, with the first portion 124 of the interior 120 inside the inlet body 180 and the second portion of the interior 120 outside of the inlet body 180.

The first fuel pump 114 has its inlet 144 received in the inlet body 180 and in communication with the first portion 124 defined by the inlet body 180. The first pump 114 draws fuel into the reservoir 112 via the first inlet 122 which leads to the first portion 124, and the first pump 114 then pumps fuel from the first portion 124 and discharges that fuel through one or both of two outlets 182, 184. A first outlet 182 is coupled to or communicated with the outlet 158 of the second pump 115, the fuel pressure regulator 160 and the main outlet 156, as in the fuel pump assembly 10. A check valve 186 prevents fuel flow from the second pump 115, or back flow when the engine 16 is off, from flowing through the first outlet 182 and first pump 114. One difference is that the first outlet 182 is not communicated with the fuel control valve 152, which is instead communicated with a second outlet 184 of the first pump 114.

The second outlet 184 of the first pump 114 directs fuel to the flow control valve 152, which when open, allows fuel flow through the valve 152 or an orifice 199 and an optional conduit 188 having an outlet 190 within the reservoir interior 120 (e.g. the second portion 126 in communication with the second pump inlet 168). A vent 192 in the conduit 188 prevents a syphoning action from occurring through the conduit 188 when the pumps 114, 115 are off to prevent draining or emptying of fuel from the reservoir 112 if the check valve 134 is not utilized. The conduit outlet 190 may be located near the bottom of the reservoir interior 120 so that it is usually submerged in liquid fuel and to direct fuel to the bottom of the reservoir interior 120. The flow control valve 152 can be opened to direct fuel to the interior 120 of the reservoir 112 and to reduce the flow rate of fuel provided from the first pump 114 to the main outlet 156. The flow control valve 152 can be controlled in the same manner(s) as set forth above with regard to the fuel pump assembly 10.

In a pressurized or enclosed/sealed reservoir, a second fuel pressure regulator 194 may be provided that has an inlet 196 communicating with the second portion 126 of the reservoir interior 120, an outlet 198 communicating with the first portion 124 of the reservoir interior 120, and a valve body 200 between them that is normally closed to prevent fuel flow through the second regulator 194. When the pressure at the inlet 196 of the regulator 194 is equal to or greater than the pressure at which the valve body 200 opens, the valve body 200 will open. This permits fuel flow through the fuel pressure regulator 194 from the second portion 126 and into the first portion 124 of the interior 120 so that fuel from the second portion 126 will be drawn into and pumped by the first pump 114. This diverts fuel from liquid fuel in the second portion 126 of the reservoir interior 120 and thereby controls the pressure therein. Until a certain level of fuel or pressure is present within the second portion 126 of the reservoir interior 120, fuel may be drawn only or primarily from the fuel source (e.g. a fuel tank), and only when the threshold pressure exists at the second regulator inlet 196 does fuel flow from the second portion 126 to the first portion 124 and into the first pump inlet 144. Of course, other arrangements are possible and will be understood to persons skilled in this art in view of this disclosure.

The second outlet 184 of the first pump 114 and conduit 188 may divert output fuel flow from the first pump 114, and may allow the first pump 114 to operate at a pressure that is below system pressure, and may allow air flow through the first pump 114 at a pressure that is below system pressure. The flow control valve 152 may be controlled to increase or decrease the diverted fuel flow. A jet or restrictive orifice 199 may also be used to control the flow rate of fuel from the first pump 114 through the second outlet 184 and conduit 188. The jet may be part of a jet pump that uses the flow of output fuel therethrough to entrain air, vapor and/or liquid fuel into the jet pump. This may be used to evacuate or vent air and vapor from the reservoir interior 120 by moving such fluids to the bottom of the reservoir interior 120 wherein they may be drawn one pump 115 (e.g. by the alternate routing of the conduit 188' shown in dashed lines in FIG. 2 with outlet 190').

Like the second pump 115, the first pump 114 may be operated in the same manner(s) as described above with regard to the fuel pump assembly 10. For example, the first pump 114 could be operated at full duty all the time and the flow control valve 152 and fuel pressure regulator 194 may divert some of the first pump output flow back into the reservoir interior 120. As another example, the first pump 114 could be operated at less than full duty including not being powered at all and relying on the operation of the second pump 115 in at least some circumstances, as desired (likewise, the second pump 115 may be shut down and the first pump 114 may provide all fuel flow from the assembly 110, in at least some instances, if desired. This may lower the total system current draw).

Further, the assemblies 10, 110 having two or more pumps described herein may meet higher fuel flow rate engine demands with lower current consumption than use of both a single, higher flow rate pump and a lower pressure lift pump that simply moves fuel from a tank to the reservoir 12, 112 but which does not have any portion of its output directly communicated with the engine 16 or assembly outlet 56, 156. The pump assemblies 10, 110 should also prove more efficient and more capable of dry priming the system as both pumps 14, 15 and 114, 115 are able to divert air from the input side to the output side of the fuel pump assembly 10, 110 (as opposed to only one pump being able to pump to the output side/main outlet of the assembly).

Further, even if one pump fails, the other pump can provide at least some fuel to the engine 16 to provide a failsafe mode in which at least some engine fuel demand can be satisfied to support at least some level of engine operation. The still operating pump can also more easily draw fuel into the reservoir interior 20, 120 due to the parallel arrangement of the fuel pumps. In prior arrangements, the fuel pumps were arranged in series with only the lift pump drawing fuel into the reservoir and only the high pressure pump delivering fuel to the engine. If the high pressure pump failed, there was little or no fuel flow to the engine. If the lower pressure lift pump failed, the high pressure pump would have to draw fuel through the lift pump to get fuel into the reservoir which either resulted in no flow into the reservoir or a low flow rate which then negatively impacted the output flow rate of the high pressure pump.

It is to be understood that the foregoing description is not a definition of the invention, but is a description of one or more preferred embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, a method having greater, fewer, or different steps than those shown could be used instead. All such embodiments, changes, and modifications are intended to come within the scope of the appended claims.

As used in this specification and claims, the terms "for example," "for instance," "e.g.," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

What is claimed is:

1. A fuel pump assembly, comprising:

a first fuel pump having an electric motor, a pumping element that is driven by the motor, an inlet through which fuel enters the first fuel pump and an outlet through which fuel is discharged from the first fuel pump;

a second fuel pump having an electric motor, a pumping element that is driven by the motor, an inlet through which fuel enters the second fuel pump and an outlet through which fuel is discharged from the second fuel pump;

a passage communicated with the outlet of the first fuel pump and with the outlet of the second fuel pump;

a fuel outlet in communication with the passage and through which fuel exits the fuel pump assembly;

a first valve having an inlet in communication with the passage between the outlet of the first fuel pump and the outlet of the second fuel pump, the valve also having an outlet through which fuel exits the passage and a valve body that controls fuel flow through the valve; and a second valve located between the outlet of the first fuel pump and the first valve, wherein the second valve prevents fuel that is discharged from the first fuel pump from reaching the first valve.

2. The assembly of claim 1 wherein the first valve is electrically operated to control movement of the valve body between open and closed positions.

3. The assembly of claim 1 wherein at least one of the first fuel pump motor and the second fuel pump motor is driven by a pulse width modulated signal.

4. The assembly of claim 1 which also includes a pressure regulator having an inlet in communication with the passage between the first valve and the second fuel pump outlet, the pressure regulator also having an outlet from which fuel exits the passage and a valve body between the inlet and the outlet, the valve body being responsive to a pressure of fuel at the pressure regulator inlet that is above a threshold pressure to permit fuel to flow through the pressure regulator outlet.

5. The assembly of claim 1 wherein, during at least some operating conditions, fuel from both the first fuel pump outlet and the second fuel pump outlet is discharged from the assembly through the fuel outlet.

6. A fuel pump assembly, comprising:

a first fuel pump having an electric motor, a pumping element that is driven by the motor, an inlet through which fuel enters the first fuel pump, a first outlet through which fuel is discharged from the first fuel pump and a second outlet through which fuel is discharged from the first fuel pump;

a second fuel pump having an electric motor, a pumping element that is driven by the motor, an inlet through which fuel enters the second fuel pump and an outlet through which fuel is discharged from the second fuel pump;

a passage communicated with the first outlet of the first fuel pump and with the outlet of the second fuel pump;

a fuel outlet in communication with the passage and through which fuel exits the fuel pump assembly; and a valve having an inlet in communication with the second outlet of the first fuel pump, an outlet through which fuel exits the valve, and a valve body that controls fuel flow through the valve, wherein when the valve body is closed to inhibit or prevent fuel flow through the valve, more fuel exits the first fuel pump through the first outlet.

7. The assembly of claim 6 which also includes a reservoir having an interior and a divider in the interior, and wherein the interior includes a first portion on one side of the divider that is in communication with the first fuel pump inlet and a second portion on the other side of the divider that is in communication with the second fuel pump inlet.

8. The assembly of claim 6 which also includes a passage communicated at one end with the valve to receive fuel that flows through the valve, and a jet or restricted orifice located in the passage downstream of said one end, wherein the jet or restricted orifice has a smaller flow area than the adjacent portions of the passage and the jet or restricted orifice controls the flow rate of fuel in the passage.

9. The assembly of claim 8 which also includes a reservoir having an interior and a divider in the interior, and wherein the interior includes a first portion on one side of the divider that is in communication with the first fuel pump inlet and a second portion on the other side of the divider that is in communication with the second fuel pump inlet, and wherein the passage has a second end through which fuel exits the passage and the second end is communicated with the second portion of the interior.

10. The assembly of claim 6 which also includes a pressure regulator having an inlet in communication with the passage, the pressure regulator also having an outlet from which fuel exits the passage and a valve body between the inlet and the outlet, the valve body being responsive to a pressure of fuel at the pressure regulator inlet that is above a threshold pressure to permit fuel to flow through the pressure regulator outlet, and wherein the pressure regulator outlet is in communication with the second fuel pump inlet.

11. The assembly of claim 6 which also includes a reservoir having an interior and a divider in the interior, and wherein the interior includes a first portion on one side of the divider that is in communication with the first fuel pump inlet and a second portion on the other side of the divider that is in communication with the second fuel pump inlet, and the interior is sealed and capable of containing fluid at above atmospheric pressure, and wherein the assembly also includes a fuel pressure regulator that has an inlet communicating with the second portion of the reservoir interior, an outlet communicating with the first portion of the reservoir interior, and a valve body between the fuel pressure regulator inlet and the fuel pressure regulator outlet that is normally closed to prevent fuel flow through the fuel pressure regulator until the pressure at the fuel pressure regulator inlet is above a threshold pressure wherein the valve body moves to an open position and fuel from the second portion of the reservoir interior flows into the first portion of the reservoir interior.

12. The assembly of claim 11 which also includes a second fuel pressure regulator having an inlet in communication with the passage, an outlet from which fuel exits the passage and a valve body between the second fuel pressure regulator inlet and the second fuel pressure regulator outlet, the valve body being responsive to a pressure of fuel at the second fuel pressure regulator inlet that is above a threshold pressure to permit fuel to flow through the second fuel pressure regulator outlet, and wherein the second fuel pressure regulator outlet is in communication with the second fuel pump inlet.

13. The assembly of claim 6 which includes a passage communicated at one end with the valve to receive fuel that flows through the valve, and a jet or restricted orifice located in the passage downstream of said one end, wherein the jet or restricted orifice has a smaller flow area than the adjacent portions of the passage and the jet or restricted orifice controls the flow rate of fuel in the passage, and wherein the passage includes an inlet arranged so that fluid flow through the jet or restricted orifice draws fluid through the inlet and into the passage.

14. The assembly of claim 7 wherein the outlet of the valve is in communication with the second portion of the interior.

15. The assembly of claim 7 which also includes a pressure regulator having an inlet in communication with the passage between the valve and the second fuel pump outlet, the pressure regulator also having an outlet from which fuel exits the passage and a valve body between the inlet and the outlet, the valve body being responsive to a pressure of fuel at the pressure regulator inlet that is above a threshold pressure to permit fuel to flow through the pressure regulator outlet, and wherein the pressure regulator outlet is in communication with the second portion of the interior.

* * * * *